US011480376B2

(12) United States Patent
Liu et al.

(10) Patent No.: US 11,480,376 B2
(45) Date of Patent: Oct. 25, 2022

(54) ICE STORAGE CONTAINER AND REFRIGERATOR HAVING SAME

(71) Applicants: HEFEI HUALING CO., LTD., Anhui (CN); HEFEI MIDEA REFRIGERATOR CO., LTD., Anhui (CN); MIDEA GROUP CO., LTD., Guangdong (CN)

(72) Inventors: Zanxi Liu, Anhui (CN); Yang Shao, Anhui (CN); Zengqiang Si, Anhui (CN); Jincai Wang, Anhui (CN)

(73) Assignees: HEFEI HUALING CO., LTD., Anhui (CN); HEFEI MIDEA REFRIGERATOR CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/253,083

(22) PCT Filed: Apr. 4, 2019

(86) PCT No.: PCT/CN2019/081452
§ 371 (c)(1),
(2) Date: Dec. 16, 2020

(87) PCT Pub. No.: WO2019/242375
PCT Pub. Date: Dec. 26, 2019

(65) Prior Publication Data

US 2021/0123651 A1 Apr. 29, 2021

(30) Foreign Application Priority Data

Jun. 19, 2018 (CN) ..... 201810628320.X

(51) Int. Cl.
*F25C 5/04* (2006.01)
*F25C 5/20* (2018.01)
(Continued)

(52) U.S. Cl.
CPC ..... *F25C 5/046* (2013.01); *F25C 1/24* (2013.01); *F25C 5/182* (2013.01); *F25C 5/22* (2018.01);
(Continued)

(58) Field of Classification Search
CPC .... F25C 5/22; F25C 1/24; F25C 5/182; F25C 2301/002; F25C 2400/04; F25C 2400/08; F25C 2400/10
See application file for complete search history.

(56) References Cited

U.S. PATENT DOCUMENTS 5,273,219 A * 12/1993 Beach, Jr. ..... F25C 5/046 222/240
7,836,719 B2 11/2010 Jeong et al.
(Continued)

FOREIGN PATENT DOCUMENTS

CN 2736715 Y 10/2005
CN 1971173 A 5/2007
(Continued)

*Primary Examiner* — Elizabeth J Martin
(74) *Attorney, Agent, or Firm* — Seed IP Law Group LLP

(57) ABSTRACT

Disclosed are an ice storage container (100) and a refrigerator (1000) having same. The ice storage container (100) includes: an ice delivering part (10) and an ice crushing part (20). The ice delivering part (10) includes: a container body (11), an ice pushing component (12), and a driving member. The container body (11) defines a first accommodating cavity (a) for accommodating ice cubes. The first accommodating cavity (a) is provided with an ice outlet (b). The ice pushing component (10) is arranged in the first accommodating cavity (a). The ice pushing component (12) includes a plurality of blades (1212). The driving member is connected to the ice pushing component (12). The blades (1212) of the ice pushing component (12) are configured to crush the ice cubes selectively based on a preset condition
(Continued)

that is forward rotation or reverse rotation. The plurality of blades (1212) push the ice towards the ice outlet (b).

20 Claims, 5 Drawing Sheets

(51) Int. Cl.
*F25C 1/24* (2018.01)
*F25C 5/182* (2018.01)

(52) U.S. Cl.
CPC .... *F25C 2301/002* (2013.01); *F25C 2400/04* (2013.01); *F25C 2400/08* (2013.01); *F25C 2400/10* (2013.01)

(56) References Cited

U.S. PATENT DOCUMENTS

| | | | | |
|---|---|---|---|---|
| 7,946,355 | B1 | 5/2011 | Kluge | |
| 2011/0049190 | A1* | 3/2011 | Sevcik | F25C 5/20 222/63 |
| 2017/0292751 | A1* | 10/2017 | Lee | F25C 5/046 |
| 2017/0292754 | A1 | 10/2017 | Yang | |

FOREIGN PATENT DOCUMENTS

| | | | |
|---|---|---|---|
| CN | 101004306 | A | 7/2007 |
| CN | 200946955 | Y | 9/2007 |
| CN | 201803544 | U | 4/2011 |
| CN | 102661645 | A | 9/2012 |
| CN | 105987553 | A | 10/2016 |
| CN | 106257176 | A | 12/2016 |
| CN | 106338169 | A | 1/2017 |
| CN | 106556193 | A | 4/2017 |
| CN | 107449195 | A | 12/2017 |
| CN | 107449213 | A | 12/2017 |
| CN | 109028688 | A | 12/2018 |
| DE | 10 2012 223 623 | A1 | 6/2014 |
| EP | 3 184 941 | A1 | 6/2017 |
| KR | 10-2004-0067646 | A | 7/2004 |
| KR | 10-2008-0029201 | A | 4/2008 |
| KR | 10-2011-0079967 | A | 7/2011 |
| KR | 10-1177462 | B1 | 8/2012 |
| KR | 10-2013-0035545 | A | 4/2013 |
| KR | 10-1450652 | B1 | 10/2014 |
| WO | 2017/209543 | A1 | 12/2017 |

* cited by examiner

ICE STORAGE CONTAINER AND REFRIGERATOR HAVING SAME

CROSS-REFERENCE TO RELATED APPLICATIONS

This application claims priority to Chinese Patent Application No. 201810628320.X, titled "ICE STORAGE CONTAINER AND REFRIGERATOR HAVING SAME", filed Jun. 19, 2018 by HEFEI HUALING CO., LTD., HEFEI MIDEA REFRIGERATOR CO., LTD., and MIDEA GROUP CO., LTD, the entire content of which is incorporated herein by reference.

TECHNICAL FIELD

This application relates to the technical field of refrigerators, particularly to an ice storage container and a refrigerator having same.

BACKGROUND

In the related art, an ice delivering part of an ice storage container is usually composed of an ice pushing screw rod, a drive motor, and a container body, with an ice outlet provided in the container body, so that when the ice delivering part is in operation, the drive motor drives the ice pushing screw rod to rotate in a fixed direction, to push ice cubes to an area of the ice outlet. In addition, an ice crushing part of the ice storage container includes an ice crushing cavity in communication with the aforementioned ice outlet, an ice discharge outlet in the ice crushing cavity, and a control lever. The control lever is driven by a motor or an electromagnet to adjust the size of the ice discharge outlet, and thus controls the discharge of whole ice cubes or crushed ice from the ice discharge outlet.

However, the existence of the control lever and the motor or electromagnet that drives the control lever increases the manufacturing cost of the ice storage container.

SUMMARY

The present disclosure aims to solve at least one of the problems existing in the related art. Accordingly, the present disclosure provides an ice storage container that can be manufactured at low cost and has good ice output effect.

The present disclosure further provides a refrigerator having the above ice storage container.

The ice storage container according to the present disclosure includes an ice delivering part and an ice crushing part. The ice delivering part includes a container body, an ice pushing component, and a driving member. The container body defines a first accommodating cavity for accommodating ice cubes, and has an ice outlet. The ice pushing component is arranged in the first accommodating cavity, and includes a plurality of blades. The driving member is connected to the ice pushing component. The plurality of blades of the ice pushing component are configured to push ice toward the ice outlet when the driving member drives the ice pushing component to rotate forwards or reversely. The ice crushing part is arranged outside the ice outlet and configured to selectively crush the ice according to a preset condition that represents forward rotation or reverse rotation.

Therefore, the ice pushing component can rotate forwardly or reversely under the drive of the driving member, and the plurality of blades of the ice pushing component can push the ice toward the ice outlet during the forward rotation or the reverse rotation, so that the ice crushing part rotates in the same direction as the ice pushing component and can perform an ice crushing function when rotating forwardly or reversely. In this way, the ice delivering part can push the ice in one direction during the forward rotation or the reverse rotation, and the ice crushing part performs an ice crushing operation or the ice cubes are pushed to be quickly discharged. As a result, the ice storage container can discharge whole ice cubes or crushed ice, separately, when the ice pushing component rotates forwardly or reversely, which can avoid the mixed discharge of whole ice cubes and crushed ice and improve the ice output effect of the ice storage container. Moreover, the ice storage container according to the embodiments of the present disclosure does not need to be provided with a control lever and a motor or an electromagnet for driving the control lever, compared with conventional ice storage containers, which can effectively reduce the production cost of the ice storage container.

The refrigerator according to the present disclosure includes: a cabinet, a door, and an ice storage container as discussed in the above embodiments. The cabinet has a refrigerating chamber therein, and the ice storage container is located in the refrigerating chamber.

Additional aspects and advantages of the present disclosure will be given in part in the following description, become apparent in part from the following description, or be learned from the practice of the present disclosure.

DETAILED DESCRIPTION

Figure 1:
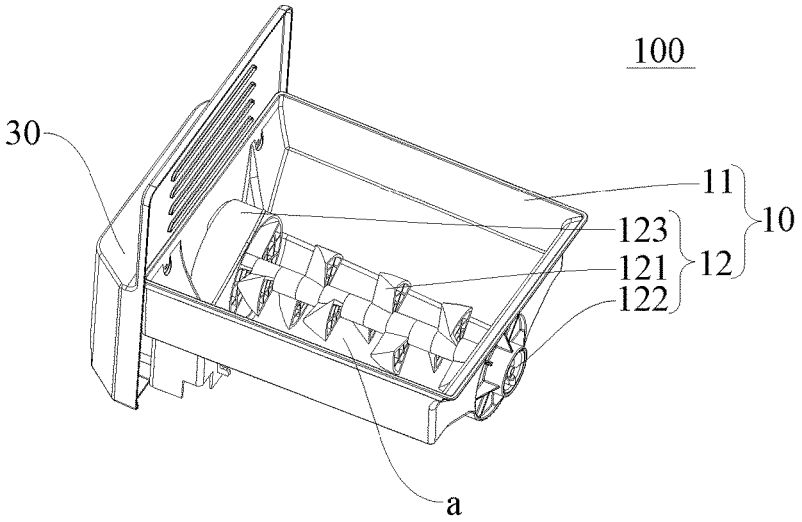
FIG. 1 is a schematic view of an ice storage container according to an embodiment of the present disclosure.

Embodiments of the present disclosure will be described in detail below, and the examples of the embodiments will be illustrated in the drawings. The same or similar elements and the elements having same or similar functions are denoted by like reference numerals throughout the description. The embodiments described herein with reference to the drawings are illustrative and used to generally explain the present disclosure. The embodiments shall not be constructed to limit the present disclosure.

An ice storage container 100 according to embodiments of the present disclosure, will be described below with reference to FIGS. 1 to 7.

Figure 2:
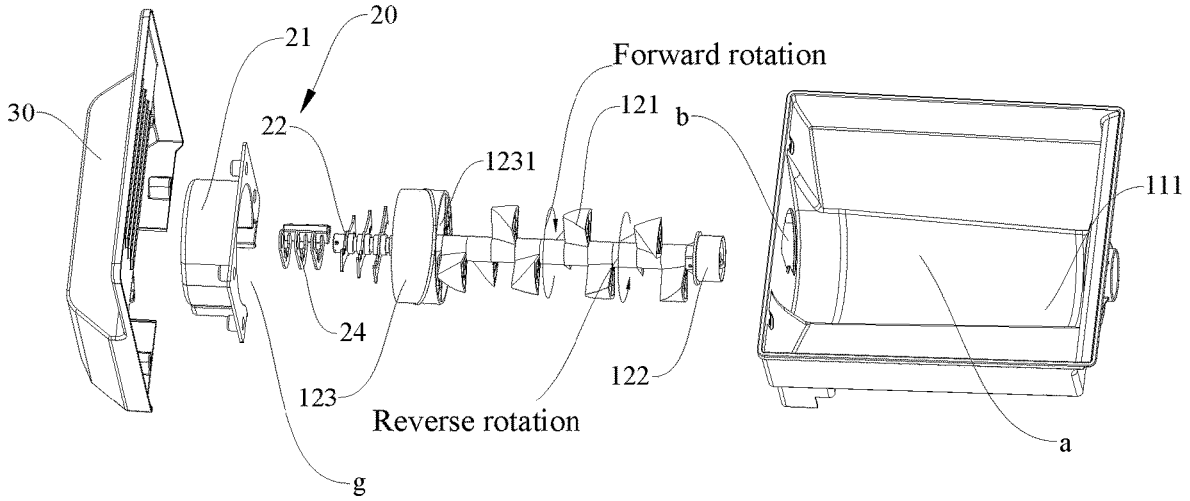
FIG. 2 is an exploded view of an ice storage container according to an embodiment of the present disclosure.

As shown in FIGS. 1 and 2, the ice storage container 100 according to an embodiment of one aspect of the present disclosure, includes an ice delivering part 10 and an ice crushing part 20. The ice delivering part 10 includes a container body 11, an ice pushing component 12, and a driving member (not shown in the drawings). The container body 11 defines a first accommodating cavity a for accommodating ice cubes, and the first accommodating cavity a has an ice outlet b. The ice pushing component 12 is arranged in the first accommodating cavity a, and includes a plurality of blades 1212. The driving member is connected to the ice pushing component 12. The blades 1212 of the ice pushing component 12 are configured in such a way that when the driving member drives the ice pushing component 12 to rotate forwards or reversely, the plurality of blades 1212 push ice toward the ice outlet b. The ice crushing part 20 is arranged outside the ice outlet b and configured to selectively crush the ice cubes according to a preset condition that represents forward rotation or reverse rotation.

In other words, the ice storage container 100 can be used to hold ice cubes, and push the ice cubes out of the first accommodating cavity a by the ice pushing component 12 when necessary, so that the ice crushing part 20 arranged outside and corresponding to the container body 11 can cooperate with the ice pushing component 12 to realize the discharge of whole ice cubes and the discharge of crushed ice.

It should be noted that when it comes to the ice crushing part 20 that is configured to selectively crush the ice cubes according to the preset condition, it means that the ice crushing part 20 crushes the ice cubes in the case of forward rotation and correspondingly allows the ice pushing component 12 to push out the whole ice cubes in the case of reverse rotation, or alternatively, the ice crushing part 20 crushes the ice cubes in the case of reverse rotation and correspondingly allows the ice pushing component 12 to push out the whole ice cubes in the case of forward rotation.

For the ice storage container 100 according to embodiments of the present disclosure, the ice pushing component 12 can rotate forwardly or reversely under the drive of the driving member, so that the plurality of blades 1212 of the ice pushing component 12 can push the ice cubes toward the ice outlet b during the forward rotation and the reverse rotation, and hence the ice crushing part 20 rotates in the same direction as the ice pushing component 12 and can perform an ice crushing function when rotating forwardly or reversely. In this way, the ice delivering part 10 can push the ice cubes in one direction during the forward rotation and the reverse rotation, and the ice crushing part 20 performs an ice crushing operation or the ice cubes are pushed to be quickly discharged. As a result, the ice storage container 100 can discharge whole ice cubes or crushed ice, separately, when the ice pushing component 12 rotates forwardly or reversely, which can avoid the mixed discharge of whole ice cubes and crushed ice and improve an ice output effect of the ice storage container 100. Moreover, the ice storage container 100 according to embodiments of the present disclosure does not need to be provided with a control lever and a motor or an electromagnet for driving the control lever, compared with conventional ice storage containers, which can effectively reduce the production cost of the ice storage container 100.

Furthermore, due to the existence of defrosting water vapor, the control lever in the prior art is prone to being frozen, so that the function that the ice storage container can output whole ice cubes and crushed ice separately is disabled. However, there is no control lever in embodiments of the present disclosure, and the ice storage container 100 can be ensured to output whole ice cubes and crushed ice separately.

It can be understood that the forward rotation and the reverse rotation refer to two rotation modes of the ice pushing component 12 in completely opposite directions. If the forward rotation is clockwise rotation, the reverse rotation is counterclockwise rotation.

Figure 3:
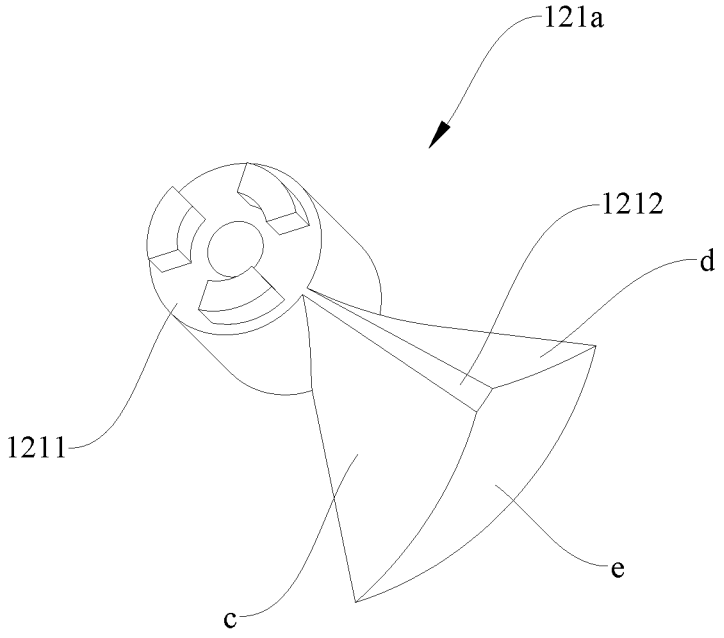
FIG. 3 is a schematic view of a first impeller of an ice pushing component according to an embodiment of the present disclosure.
Figure 4:
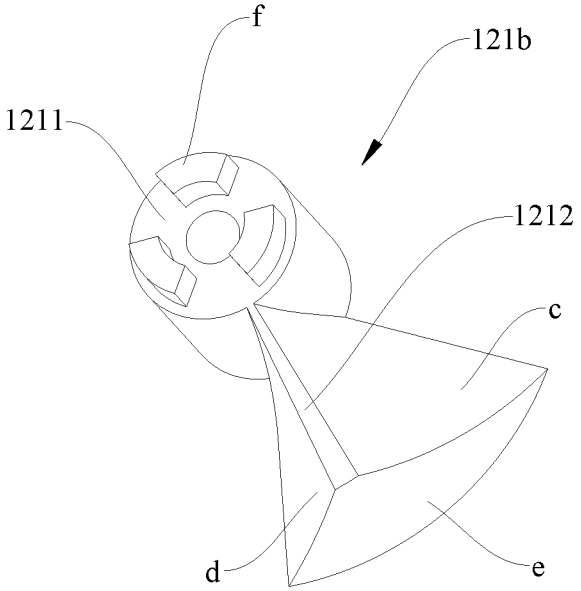
FIG. 4 is a schematic view of a second impeller of an ice pushing component according to an embodiment of the present disclosure.

As shown in FIGS. 2-4, the plurality of blades 1212 are distributed in a circumferential direction and spaced apart sequentially in an axial direction. Each blade 1212 includes a first ice pushing surface c and a second ice pushing surface d. The first ice pushing surface c and the second ice pushing surface d are inclined in opposite directions with respect to a rotation center of the ice pushing component 12.

Specifically, the plurality of blades 1212 are spaced apart in the axial direction, a rotation center of the inclined first ice pushing surface c of each blade 1212 is inclined toward a first direction, and a rotation center of the inclined second ice pushing surface d of each blade 1212 is inclined toward a second direction opposite the first direction. Hence, first ice pushing surfaces c of the plurality of blades 1212 form a first spiral approximate curved surface when the blades 1212 rotate, and second ice pushing surfaces d of the plurality of blades 1212 form a second spiral approximate curved surface when the blades 1212 rotate, such that the ice cubes are pushed toward the ice outlet b by an ice pushing force generated by the first ice pushing surfaces c and the second ice pushing surfaces d.

In this way, the first spiral approximate curved surface formed by the first ice pushing surfaces c and the second spiral approximate curved surface formed by the second ice pushing surfaces d can push ice cubes together, improving an ice delivering effect of the ice pushing component 12 and pushing out the ice cubes in the container body 11 more completely and fully; moreover, when the ice pushing component 12 rotates forwardly or reversely, the ice cubes are pushed by the first ice pushing surface c of one of the adjacent blades 1212 and the second ice pushing surface d of the other blade 1212 of the adjacent blades so as to keep the ice pushing force of the ice pushing component 12 consistent during the forward rotation and the reverse rotation. As a result, the ice output of the ice delivering part 10 is consistent during the forward rotation and the reverse rotation.

In a specific embodiment, the first ice pushing surface c and the second ice pushing surface d are each formed as a flat surface or an arc surface.

That is, in some embodiments, the ice pushing surface is formed as a flat surface, and in other embodiments, the ice pushing surface is formed as an arc surface. In this way, when the ice pushing surface is formed as a flat surface, a contact area between the blade 1212 and ice cubes can be reduced, and the ice cubes discharged from the container body 11 are more complete; when the ice pushing surface is arc-shaped, each blade 1212 can push more ice cubes, further improving the ice pushing efficiency of the ice pushing component 12 and increasing the ice output per unit time of the ice storage container 100.

In a specific embodiment shown in FIGS. 3 and 4, inclination angles of the first ice pushing surfaces c of the plurality of blades 1212 are equal, and inclination angles of the second ice pushing surfaces d of the plurality of blades 1212 are equal; the first ice pushing surface c of one blade 1212 of any adjacent blades 1212 is arranged to face or face away from the first ice pushing surface c of the other blade 1212.

That is, respective first ice pushing surfaces c of the adjacent blades 1212 are arranged to face each other or face away from each other. Accordingly, the second ice pushing surfaces c of the adjacent blades 1212 are arranged to face each other or face away from each other. In this way, the inclination angles of the first ice pushing surface c and the second ice pushing surface d of each blade 1212 are the same, thereby simplifying and facilitating the processing of the blades 1212. Moreover, as the first ice pushing surface c of one of the adjacent blades 1212 and the second ice pushing surface d of the other blade 1212 of the adjacent blades can be used to push the ice cubes, while the second ice pushing surface d of the one blade and the first ice pushing surface c of the other blade can be used to provide guidance for the ice cubes, the ice pushing component 12 allows the long-distance transportation and pushing of the ice cubes in a continuous and smooth way.

It should be noted that a front-rear direction and an up-down direction mentioned in the present disclosure are consistent with a front-rear direction and an up-down direction of a refrigerator 1000.

According to some embodiments of the present disclosure, projections of the adjacent blades 1212 along a direction of a rotating axis of the ice pushing component 12 are staggered with a staggered angle of 120° or 90°. In this way, the plurality of blades 1212 are evenly distributed at an angle of 120° or 90°, which not only makes the force between the plurality of blades 1212 more uniform, but also allows ice cubes within a range of 360° of a single blade 1212 to move toward the ice outlet b under the push of the blades 1212, resulting in better ice delivery of the ice delivering part 10 and less residual ice.

It should be noted that the staggered angle between adjacent blades 1212 means an angle between symmetrical central sections of the adjacent blades 1212 perpendicular to an axis of the rotation in a direction of the axis.

As shown in FIGS. 3 and 4, in a direction gradually approaching the ice outlet b along the axial direction, the first ice pushing surface c and the second ice pushing surface d gradually approach to each other, and a width of a cross section of the blade 1212 gradually increases from an inner end to an outer end of the blade 1212.

Specifically, both the first pushing ice surface c and the second pushing ice surface d of the same blade 1212 extend toward the ice outlet b and close to a central axis. In this way, both the first ice pushing surface c and the second ice pushing surface d can provide guidance for the ice cubes when pushing the ice cubes, to allow the ice cubes to move more smoothly in the first accommodating cavity a and reduce the ice pushing noise on the premise of guaranteeing the ice pushing efficiency.

Figure 5:
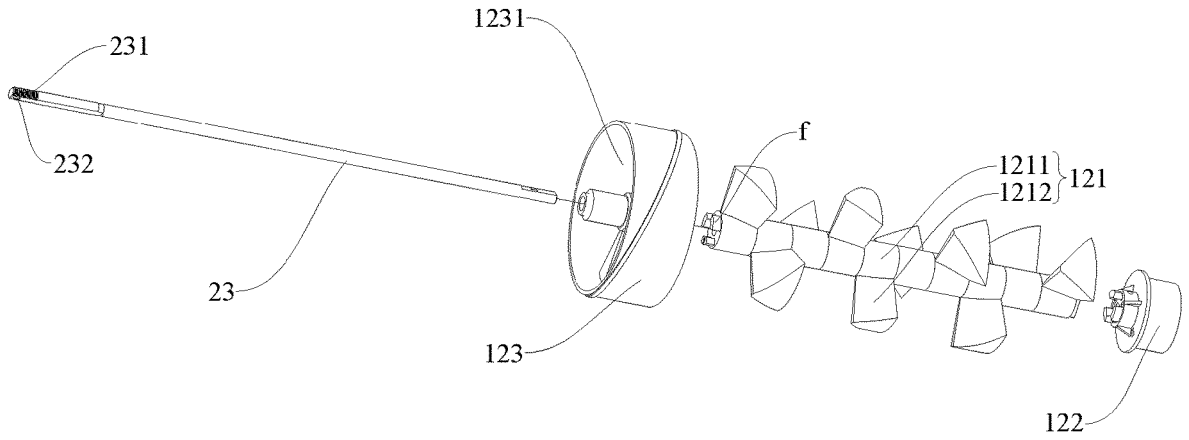
FIG. 5 is a schematic view of an ice pushing component and a connecting shaft according to an embodiment of the present disclosure.

As shown in FIG. 5, each blade 1212 is fixed with a corresponding wheel body 1211, and wheel bodies 1211 of the adjacent blades 1212 are detachably connected to each other. In other words, the wheel body 1211 and the blade 1212 together constitute an impeller 121, and adjacent wheel bodies 1211 are detachably connected.

Specifically, a plurality of impellers 121 include a first impeller 121*a* and a second impeller 121*b*, a plurality of first impellers 121*a* are spaced apart from each other, and one second impeller 121*b* is arranged between every two first impellers 121*a* (i.e., the arrangement order of the plurality of impellers 121 is one first impeller 121*a*, one second impeller 121*b*, another first impeller 121*a*, another second impeller 121*b*, and so on). Moreover, a first ice pushing surface c of the first impeller 121*a* and a second ice pushing surface d of the second impeller 121*b* are arranged corresponding to each other.

Therefore, the ice pushing capacity of the ice delivering part 10 by the forward rotation and the reverse rotation can be effectively improved, and the plurality of blades 1212 can be detachably connected, making the disassembly and assembly of the ice pushing component 12 easier and more convenient. The detachable blades also help to avoid rigid connection between the plurality of impellers 121, and thus effectively reduces the noise during the operation of the ice pushing component 12.

In a specific embodiment shown in FIGS. 1 and 2, the ice pushing component 12 further includes a driving wheel 122 and an ice guiding wheel 123. The driving wheel 122 is connected to one of the wheel bodies 1211, which is the farthest from the ice outlet b, and the ice guiding wheel 123 is connected to the one of the wheel bodies 1211, which is the closest to the ice outlet b. An end of the ice guiding wheel 123 facing away from the wheel body 1211 is located inside the container body 11 and corresponds to a first end of the container body 11, and the ice guiding wheel 123 has an ice guiding cavity 1231 in communication with the ice outlet b. An end of the driving wheel 122 facing the wheel body 1211 is located outside the container body 11 and corresponds to a second end of the container body 11, and the driving wheel 122 is connected with the driving member to transmit a torque.

The ice guiding wheel 123 is located in the first accommodating cavity a and close to the ice outlet b. The driving wheel 122 is located outside the container body and at an end facing away from and opposite to the ice outlet b. The driving wheel 122 and the driving member cooperate transmissively to transmit power to the ice pushing component 12 and to space the ice pushing component 12 from the driving member.

Therefore, by providing the ice guiding wheel 123, and making the ice guiding cavity 1231 of the ice guiding wheel 123 in communication with the ice outlet b, the ice cubes can be discharged from the first accommodating cavity a through the ice outlet b, the ice output of the ice outlet b can be kept stable, and the ice output effect of the ice delivering part 10 can be kept stable. Moreover, by providing the driving wheel 122, the ice pushing component 12 can be spaced from the driving member, and the ice cubes in the first accommodating cavity a can be prevented from splashing out of the first accommodating cavity a, so that the driving member can be prevented from being frozen under the action of the splashed ice cubes and hence from downtime. As a result, the operational stability of the ice delivering part 10 can be effectively improved.

As shown in FIG. 5, the blade 1212 is connected to a sidewall of the wheel body 1211. A first end of each wheel body 1211 has an insertion boss f and a second end thereof has an insertion groove (not shown in the figure). The insertion groove of each wheel body 1211 is fitted with the insertion boss f of another adjacent wheel body 1211.

Specifically, the blade 1212 is connected to the sidewall of the wheel body 1211 or is integrally formed with the wheel body 1211. An end, facing the ice outlet b, of the wheel body 1211 has the insertion boss f, and an end, facing away from the ice outlet b, of another corresponding wheel body 1211 has the insertion groove, so that the insertion boss f of the blade 1212, relatively farther from the ice outlet b, among the plurality of blades 1212 connected in sequence is inserted into the insertion groove of another blade 1212 located in front thereof.

In this way, the connection between the plurality of blades 1212 becomes more stable by providing the insertion boss f and the insertion groove, and the insertion fit through the insertion boss f and the insertion groove replaces the rigid connection between an ice pushing screw rod of a conventional ice pushing component and the surrounding parts, thereby effectively reducing the co-vibration during the operation of the ice pushing component 12 and lowering the noise of the ice pushing component 12 during operation.

In a specific embodiment, a cross section of the insertion groove and a cross section of the insertion boss f are both fan-shaped, and a plurality of insertion bosses f and a plurality of insertion grooves of each blade 1212 are evenly distributed along the circumferential direction. Specifically, the insertion bosses f evenly distributed along the circumferential direction and the insertion grooves evenly distributed along the circumferential direction are arranged in a staggered manner and fitted with each other by insertion. In this way, on the premise of ensuring the connection strength of the plurality of blades 1212, the force between the insertion grooves and the insertion bosses f inserted into the insertion grooves can be more uniform, and the power transmission in the ice pushing component 12 realized by the insertion fitting between the insertion bosses f and the insertion grooves can be more stable.

As shown in FIGS. 3 and 4, an end of the first ice pushing surface c facing the ice outlet b intersects with an end of the second ice pushing surface d facing the ice outlet b, on a plane extending outward from an end of the wheel body 1211 facing the ice outlet b, in which the plane is flush with an end surface of the end of the wheel body 1211 facing the ice outlet b. Thus, the transition of an area where the first ice pushing surface c intersects the second ice pushing surface d is relatively smooth, and the damage to the ice cubes in the ice pushing process can be reduced, so that the ice cubes discharged through the ice outlet b can have a high degree of completeness and better quality.

In a specific embodiment shown in FIG. 2, a top of the container body 11 is open, and a bottom wall 111 of the container body 11 is gradually inclined downward in the direction gradually approaching the ice outlet b along the axial direction. In this way, the top of the container body 11 is open, making it easier and more convenient for the ice cubes to enter the first accommodating cavity a, and the bottom wall 111 gradually inclined downward allows the ice cubes to slide toward the ice outlet b under the action of the ice pushing component 12 and gravity, to discharge the ice cubes in the first accommodating cavity a more fully and completely and reduce the quantity of ice cubes remaining in the first accommodating cavity a.

As shown in FIGS. 2 and 3, the bottom wall 111 of the container body 11 is arc-shaped; the outer end of each blade 1212 has a blade outer end surface e connecting the ice pushing surfaces on both sides of the blade 1212; and a shape of the blade outer end surface e is consistent with a shape of the bottom wall 111 of the container body 11.

Specifically, the arc-shaped bottom wall 111 of the container body 11 conforms to the blade outer end surfaces e of the plurality of impellers 121 in shape, and when the blades 1212 rotate, at least a part of the blade outer end surfaces e of the blades 1212 always face the bottom wall 111 of the container body 11, so that in a process where the ice cubes are gradually moved toward the ice outlet b under the drive of the ice pushing component 12, more ice cubes can be pushed out, thereby further reducing the quantity of ice cubes remaining in the container body 11.

According to some embodiments of the present disclosure, the ice crushing part 20 includes an ice blade component and a cover 21. The ice blade component includes a rotatable, movable ice blade 22 and a fixed ice blade 24 fixed to the cover 21. The movable ice blade 22 is connected to the driving member by a connecting shaft 23 to be moved in synchronization with the ice pushing component 12. A blade edge 221 of the movable ice blade 22 is configured to selectively perform an ice crushing operation according to a preset condition. The cover 21 covers the ice crushing part 20 and is connected to the outside of the container body 11. The container body 11 has an ice discharge outlet g, that is, the cover 21 and the container body 11 form a second accommodating cavity, and the ice discharge outlet g is at the bottom of the second accommodating cavity.

Specifically, the movable ice blade 22 is brought into rotation by the connecting shaft 23, and one side of the movable ice blade 22 has the blade edge 221, so that when the ice pushing component 12 rotates forward (or reversely) to discharge the ice cubes, another side of the movable ice blade 22 that does not have the blade edge 221 faces the ice cubes to be discharged from the ice outlet b, so as to achieve a function of discharging the whole ice cubes. Accordingly, when the ice pushing component 12 rotates reversely (or forward) to discharge the ice cubes, the blade edge 221 of the movable ice blade 22 faces the ice cubes to be discharged from the ice outlet b, to push the ice cubes against the fixed ice blade 24, so that the ice cubes are crushed under the action of the blade edge 221 and an ice crushing function of the ice pushing component 12 can be achieved (see FIG. 7).

Exemplarily, the whole ice cubes and crushed ice are discharged respectively when the ice pushing component 12 rotates forwardly or reversely. Specifically, when the ice pushing component 12 is in forward rotation, the whole ice cubes discharged from the ice outlet b is pushed to the ice discharge outlet g by the movable ice blade 22 or falls by gravity to the ice discharge outlet g, so that the whole ice cubes can be directly discharged. When the ice pushing component 12 is in reverse rotation, the whole ice cubes discharged from the ice outlet b is pushed to the fixed ice blade 24 by the movable ice blade 22 to undergo the ice crushing operation, thereby realizing the ice crushing function.

Therefore, the ice storage container 100 according to the present disclosure, can discharge the crushed ice or the whole ice cubes correspondingly when the ice pushing component 12 rotates forwardly or reversely, so that the ice storage container 100 can discharge the whole ice cubes or the crushed ice through one ice discharge outlet g. The ice storage container 100 having simpler structure, more convenient use, and lower production cost can thus be obtained. Moreover, the mixing of the whole ice cubes and the crushed ice can be avoided, and the quantity of the whole ice cubes can be consistent with the quantity of the crushed ice, resulting in better effects in terms of discharging the whole ice cubes and the crushed ice.

As shown in FIG. 5, both ends of the connecting shaft 23 have an offset structure arranged at a certain angle. A first end of the connecting shaft 23 facing the movable ice blade 22 is provided with a threaded connection portion 231 and a positioning hole 232, the threaded connection portion 231 is threaded with the movable ice blade 22, and anti-rotation limitation is realized by the positioning hole 232. A second end of the connecting shaft 23 facing the driving member is also designed with an offset structure.

In this way, the torque of the driving member can be transmitted directly to the movable ice blade 22 located in front of the container body 11, and the movable ice blade 22 can crush or push out the ice cubes. Such design can effectively avoid the loss of the torque of the driving member during the transmission process, and improve the ice output efficiency and the ice crushing efficiency of the ice storage container 100. Moreover, by providing the offset structure, the connection between the connecting shaft 23 and the driving member, and the connection between the connecting shaft 23 and the movable ice blade 22 can be more stable and reliable. The offset structure can also prevent the ice cubes from being splashed out of the container body 11 via a through hole where the connecting shaft 23 is connected to the driving wheel 122, and enhance the operational stability of the driving member and the driving wheel 122.

In a specific embodiment, the ice pushing component 12 includes a driving wheel 122, an ice guiding wheel 123, and a plurality of impellers 121 connected between the driving wheel 122 and the ice guiding wheel 123. The blades 1212 are formed on the impellers 121. The connection shaft 23 passes through the ice guiding wheel 123 and the plurality of impellers 121 sequentially to be connected to the driving wheel 122.

Therefore, since the connecting shaft 23 passes through the plurality of impellers 121, and the impellers, located at both ends, among the plurality of impellers 121 are connected to the driving wheel 122 and the ice guiding wheel 123, respectively, the structural stability and structural strength of the ice pushing component 12 can be enhanced, and the concentricity of the ice pushing component 12 can become higher by the connecting shaft 23, to further reduce the vibration of the ice pushing component 12 and the ice storage container 100 during the ice pushing process.

As shown in FIG. 2, the ice storage container 100 also includes a housing 30 that covers the ice crushing part 20 and is connected to the container body 11 of the ice delivering part 10. In this way, the ice crushing part 20 can be spaced away from the outside by the housing 30 to prevent splashing of the crushed ice during the ice crushing process.

Figure 6:
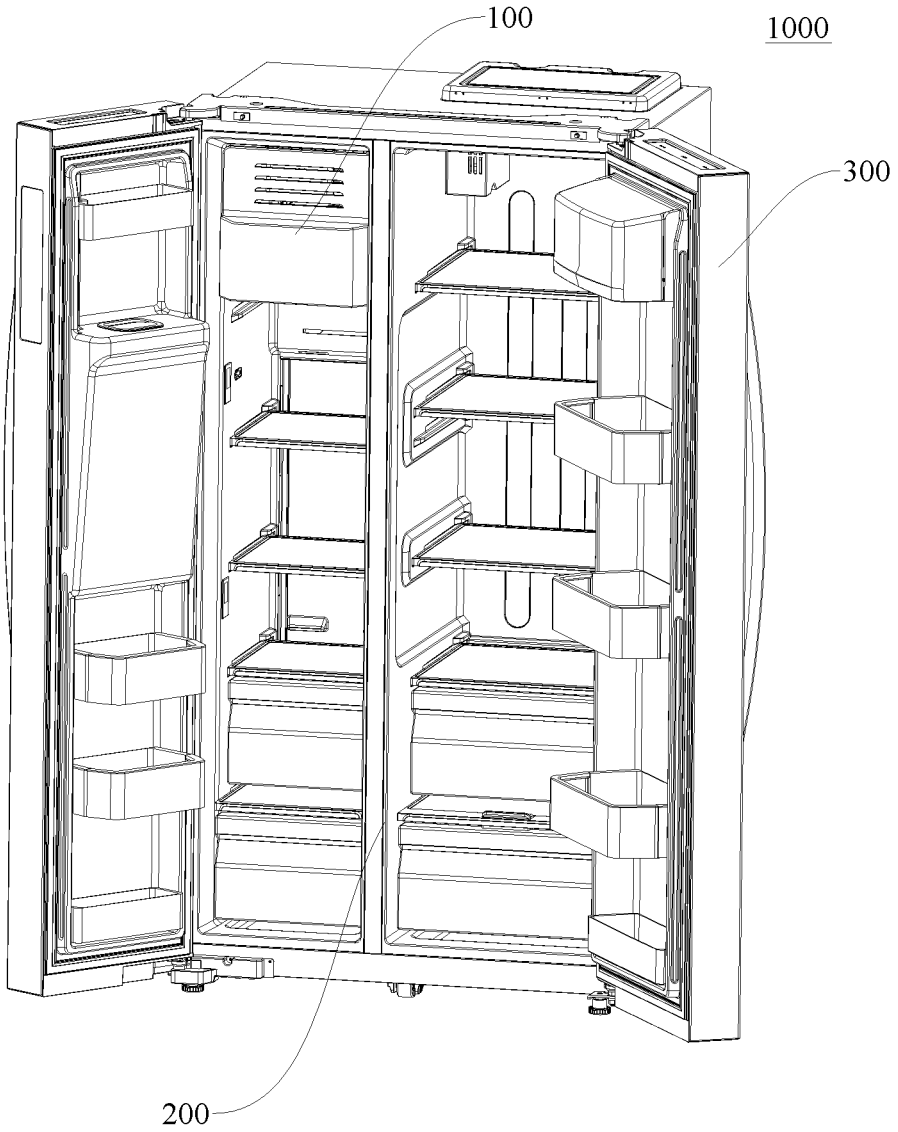
FIG. 6 is a schematic view of a refrigerator according to an embodiment of the present disclosure.
Figure 7:
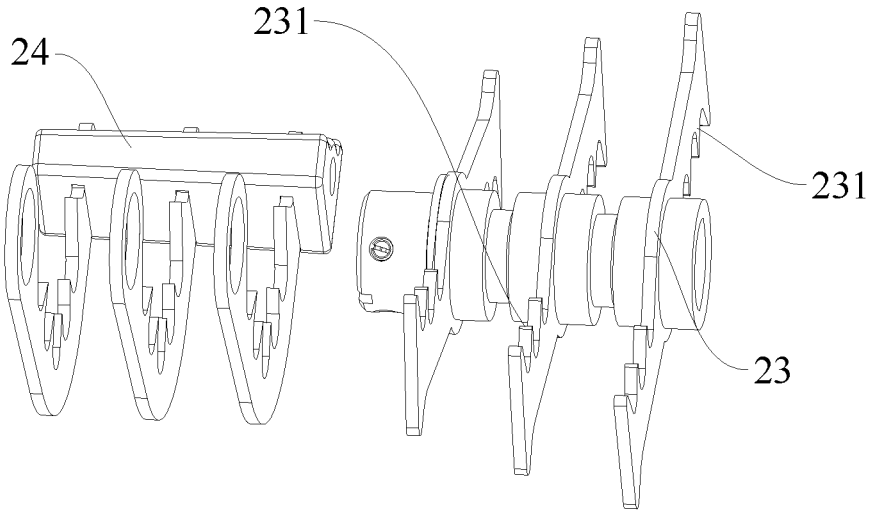
FIG. 7 is a schematic view of a movable ice blade and a fixed ice blade according to an embodiment of the present disclosure.

As shown in FIG. 6, a refrigerator 1000 according to an embodiment of another aspect of the present disclosure includes: a cabinet 200, a door 300, and an ice storage container 100 as discussed in the above embodiments. The cabinet 200 has a refrigerating chamber therein, and the ice storage container 100 is located in the refrigerating chamber.

For the refrigerator 1000 according to the embodiment of the present disclosure, the ice storage container 100 is arranged in the refrigerating chamber, and when necessary, the crushed ice or whole ice cubes can be taken out through an ice discharge outlet g of the ice storage container 100. The ice storage container 100 has a good ice output effect, and the refrigerator 1000 is simple and convenient to use.

In the description of the present disclosure, terms such as "central," "longitudinal," "lateral," "length," "width," "thickness," "upper," "lower," "front," "rear," "left," "right," "vertical," "horizontal," "top," "bottom," "inner," "outer" "clockwise," "counterclockwise," "axial," "radial," and "circumferential" and the like should be constructed to refer to the orientation or position as then described or as shown in the drawings under discussion. These terms are for convenience and simplification of description and do not indicate or imply that the device or element referred to must have a particular orientation, or be constructed and operated in a particular orientation, so these terms shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

In the description of the present specification, reference throughout this specification to "an embodiment," "some embodiments," "an example," "a specific example," "some examples" or the like means that a particular feature, structure, material, or characteristic described in connection with the embodiment or example is included in at least one embodiment or example of the present disclosure. In the specification, the appearances of the above-mentioned terms are not necessarily referring to the same embodiment or example. Furthermore, the particular features, structures, materials, or characteristics described can be combined in any suitable manner in one or more embodiments or examples.

Although embodiments of the present disclosure have been shown and described, it shall be appreciated that the above embodiments are exemplary and are not constructed to limit the present disclosure, and various changes, modifications, alternatives, and variations can be made in the embodiments by those skilled in the art within the scope of the present disclosure.

What is claimed is:

1. An ice storage container, comprising:

an ice delivering part comprising:

a container body defining a first accommodating cavity for accommodating ice cubes, and having an ice outlet;

an ice pushing component arranged in the first accommodating cavity, and comprising a plurality of blades wherein the plurality of blades of the ice pushing component are configured to push the ice cubes toward the ice outlet when the ice pushing component is driven to rotate in a forward direction or a reverse direction; and an ice crushing part arranged outside the ice outlet and configured to selectively crush the ice cubes according to a preset condition that represents the ice pushing component being rotated in the forward direction or the reverse direction, wherein the plurality of blades are distributed in a circumferential direction and spaced apart sequentially in an axial direction, each blade of the plurality of blades comprises a first ice pushing surface and a second ice pushing surface, the first ice pushing surface and the second ice pushing surface are side surfaces formed on both sides of each blade of the plurality of blades and are inclined in opposite directions with respect to a rotation center of the ice pushing component, and wherein in a direction approaching the ice outlet along an axial direction thereof, the first ice pushing surface and the second ice pushing surface of a blade of the plurality of blades approach each other, and a width of a cross section of the blade of the plurality of blades increases from an inner end to an outer end of the blade of the plurality of blades.

2. The ice storage container according to claim 1, wherein the first ice pushing surface and the second ice pushing surface are each formed as a flat surface or an arc surface.

3. The ice storage container according to claim 2, wherein inclination angles of the first ice pushing surfaces of the plurality of blades are equal, and inclination angles of the second ice pushing surfaces of the plurality of blades are equal, and wherein a first ice pushing surface of each blade of the plurality of blades is arranged to face toward or face away from a first ice pushing surface of an adjacent blade of the plurality of blades.

4. The ice storage container according to claim 1, wherein projections of adjacent blades of the plurality of blades along a direction of a rotating axis of the ice pushing component are staggered with a staggered angle of 120° or 90°.

5. The ice storage container according to claim 1, wherein each blade of the plurality of blades is fixed with a corresponding wheel body of a plurality of wheel bodies, and wheel bodies of adjacent blades are detachably connected to each other.

6. The ice storage container according to claim 5, wherein the ice pushing component further comprises a driving wheel and an ice guiding wheel, wherein the driving wheel is connected to a wheel body of the plurality of wheel bodies that is farthest from the ice outlet, and the ice guiding wheel is connected to a wheel body of the plurality of wheel bodies that is closest to the ice outlet, an end of the ice guiding wheel facing away from the plurality of wheel bodies is located inside the container body and corresponds to a first end of the container body, the ice guiding wheel has an ice guiding cavity in communication with the ice outlet, and an end of the driving wheel facing the plurality of wheel bodies is located outside the container body and corresponds to a second end of the container body, and the driving wheel is connected with the ice pushing component to transmit a torque.

7. The ice storage container according to claim 5, wherein the blade is connected to a sidewall of the wheel body, wherein a first end of each wheel body has an insertion boss and a second end thereof has an insertion groove, and the insertion groove of each wheel body is fitted with the insertion boss of another adjacent wheel body.

8. The ice storage container according to claim 7, wherein a cross section of the insertion groove and a cross section of the insertion boss are both fan-shaped, and a plurality of insertion bosses and a plurality of insertion grooves of each blade are evenly distributed along a circumferential direction.

9. The ice storage container according to claim 1, wherein a top of the container body is open, and a bottom wall of the container body is inclined downward in a direction approaching the ice outlet along an axial direction.

10. The ice storage container according to claim 1, wherein a bottom wall of the container body is arc-shaped, and an outer end of each blade has a blade outer end surface connecting the first and second ice pushing surfaces on both sides of the blade, and a shape of the blade outer end surface is consistent with the shape of the bottom wall of the container body.

11. The ice storage container according to claim 1, wherein the ice crushing part comprises:

an ice blade component arranged corresponding to the ice outlet, and comprising a movable ice blade and a fixed ice blade, wherein the movable ice blade is connected to a connecting shaft to be driven to rotate in synchronization with the ice pushing component, and a blade edge of the movable ice blade is configured to selectively perform an ice crushing operation according to the preset condition; and a cover configured to cover the ice crushing part, the cover connected to the outside of the container body and including an ice discharge outlet.

12. The ice storage container according to claim 11, wherein the ice pushing component comprises:

a driving wheel;

an ice guiding wheel; and a plurality of impellers connected between the driving wheel and the ice guiding wheel, wherein the plurality of blades are formed on the plurality of impellers, the connecting shaft passes through the ice guiding wheel, and the plurality of impellers is sequentially connected to the driving wheel.

13. The ice storage container according to claim 11, further comprising a housing that covers the ice crushing part and is connected to the container body of the ice delivering part.

14. A refrigerator, comprising:

a cabinet;

a door; and the ice storage container according to claim 1, wherein the cabinet comprises a refrigerating chamber, and the ice storage container is located in the refrigerating chamber.

15. An ice storage container, comprising:

an ice delivering part comprising:

a container body, the container body defining a first accommodating cavity for accommodating ice cubes and comprising an ice outlet; and an ice pushing component in the first accommodating cavity and configured to rotate in a forward direction or a reverse direction, the ice pushing component comprising a plurality of impellers configured to push the ice cubes outside of the container body through the ice outlet;

an ice crushing part arranged outside the container body and configured to selectively crush the ice cubes being pushed out of the ice outlet when a preset condition is met; and a housing adapted to cover the ice crushing part, wherein the plurality of impellers comprises a plurality of wheel bodies detachably connected to each other and a plurality of blades, each of the plurality of blades attached to a corresponding wheel body of the plurality of wheel bodies.

16. The ice storage container of claim 15, wherein the preset condition corresponds to the ice pushing component being rotated in the forward direction or the reverse direction.

17. The ice storage container of claim 15, wherein blades of the plurality of blades attached to adjacent wheel bodies of the plurality of wheel bodies are oriented in opposite directions.

18. An ice storage container, comprising:

an ice delivering part comprising:

a container body defining a first accommodating cavity for accommodating ice cubes, and having an ice outlet;

an ice pushing component arranged in the first accommodating cavity, and comprising a plurality of blades wherein the plurality of blades of the ice pushing component are configured to push the ice cubes toward the ice outlet when the ice pushing component is driven to rotate in a forward direction or a reverse direction; and an ice crushing part arranged outside the ice outlet and configured to selectively crush the ice cubes according to a preset condition that represents the ice pushing component being rotated in the forward direction or the reverse direction, wherein each blade of the plurality of blades is fixed with a corresponding wheel body of a plurality of wheel bodies, and wheel bodies of adjacent blades are detachably connected to each other, and wherein the blade is connected to a sidewall of the wheel body, wherein a first end of each wheel body has an insertion boss and a second end thereof has an insertion groove, and the insertion groove of each wheel body is fitted with the insertion boss of another adjacent wheel body.

19. The ice storage container of claim 18, wherein the ice pushing component further comprises a driving wheel and an ice guiding wheel, wherein the driving wheel is connected to a wheel body of the plurality of wheel bodies that is farthest from the ice outlet, and the ice guiding wheel is connected to a wheel body of the plurality of wheel bodies that is closest to the ice outlet, an end of the ice guiding wheel facing away from the plurality of wheel bodies is located inside the container body and corresponds to a first end of the container body, the ice guiding wheel has an ice guiding cavity in communication with the ice outlet, and an end of the driving wheel facing the plurality of wheel bodies is located outside the container body and corresponds to a second end of the container body, and the driving wheel is connected with the ice pushing component to transmit a torque.

20. The ice storage container according to claim 18, wherein a cross section of the insertion groove and a cross section of the insertion boss are both fan-shaped, and a plurality of insertion bosses and a plurality of insertion grooves of each blade are evenly distributed along a circumferential direction.

* * * * *